United States Patent [19]

Bass

[11] 3,991,699

[45] Nov. 16, 1976

[54] ANCHOR HOLDER

[76] Inventor: Jacob Bass, 89 Fuller Drive, West Hartford, Conn. 06117

[22] Filed: Mar. 18, 1976

[21] Appl. No.: 668,194

[52] U.S. Cl. ..... 114/210; 248/214; 248/286

[51] Int. Cl.[2] ..... B63B 21/22

[58] Field of Search ..... 114/210, 206 R, .5 R; 9/1.7; 248/214, 221, 230, 286, 4

[56] References Cited

UNITED STATES PATENTS

| | | | |
|---|---|---|---|
| 2,718,865 | 9/1955 | Kurzmann | 114/210 |
| 3,804,051 | 4/1974 | Norton | 114/210 |
| 3,935,830 | 2/1976 | Cox | 114/210 |

*Primary Examiner*—Trygve M. Blix
*Assistant Examiner*—Sherman D. Basinger

[57] ABSTRACT

An adjustable storage device which mounts on the outboard side of the rail or pulpit of a vessel and holds an anchor positioned therein in a shackled condition. The overall dimensions of the storage device may be varied so as to accommodate anchors of different size and type.

10 Claims, 5 Drawing Figures

ANCHOR HOLDER

BACKGROUND OF THE INVENTION

1. Field of the Invention

The present invention relates to anchor holders and particularly to devices for supporting and storing anchors of the twin-fluke type. Accordingly, the general objects of the present invention are to provide novel and improved apparatus of such character.

2. Description of the Prior Art

While not limited thereto in its utility, the present invention has been found to be particularly well suited for the storage of anchors on motor or sailboats with bow or stern pulpits. It is, of course, necessary that virtually all types of vessels be provided with an anchor. Due to the desirable holding power versus weight characteristics thereof, the most popular type of anchor presently in use on pleasure boats is of the twin-fluke Danforth type. Twin-fluke anchors of the Danforth or similar type provide considerable holding power while neither weighing nor costing as much as conventional anchors which exhibit equivalent holding power. However, it is generally inconvenient if not impossible to store a twin-fluke anchor below decks on most pleasure vessels. In any event, storage below decks limits the emergency value of the anchor.

Because of the inability or inconvenience of below deck storage, use of on-deck anchor holders has been suggested and occasionally attempted. On-deck storage, however, has a number of significant disadvantages. These disadvantages include the anchor taking up the limited and otherwise usable deck space thus precluding the lying or sitting on the deck, the possibility of crew tripping over the anchor, the anchor marring the finish of the deck, the deck becoming exceedingly dirty each time the anchor is hoisted on board, the need to drill holes in the deck for the anchor chocks with the inherent possibility of leakage resulting and, most importantly, the possibility of sails or lines catching on the exposed anchor.

Anchor holders and mounts previously proposed or available have been unable to solve the problem of above-deck anchor storage which would safely present the anchor in a position where it is always ready to use while not being in the way during those times when use was not desired.

SUMMARY OF THE INVENTION

The present invention overcomes the above briefly discussed and other deficiencies and disadvantages of the prior art by providing a novel and improved anchor holder which mounts on the outboard side of the rail or pulpit of a vessel. The anchor holder of the present invention, in a preferred embodiment, is adjustable so as to fit various angled bow and stern pulpits and the holder may further be adjustable in length so as to accommodate many different sizes of anchor. The holder of the present invention is designed to receive different types of anchors, in a shackled condition, where it is safely held and ready for use.

In accordance with a preferred embodiment of the invention, an anchor holder in accordance with the invention includes an elongated main generally U-shaped channel defining member which receives the anchor shank. The main channel member is provided, adjacent its upper end and on the inboard facing side thereof, with a rail engaging bracket which may be angularly adjustable. The main channel member is also provided, adjacent its upper end, with a pair of aligned holes provided to receive a locking pin which engages the hole in the upper end of the anchor shank. Intermediate its ends the main channel member includes an outwardly extending member which supports, with the anchor in the stored position, the anchor chain. Adjacent its lower end, and movable with respect thereto in one embodiment, the main channel member is provided with an outwardly extending retainer bracket designed to engage the flukes of an anchor. Between the fluke retainer bracket and the chain support member, and extending in the inboard direction from the main channel member, an anchor holder in accordance with the preferred embodiment of the invention includes an adjustable extension bracket which engages a stanchion of the vessel pulpit or rail. This extension bracket may be angularly adjustable and may also be movable along the length of the main channel member. The main channel member may, if deemed necessary or desirable, be of telescoping construction.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figures 1, 2, 3, 4:
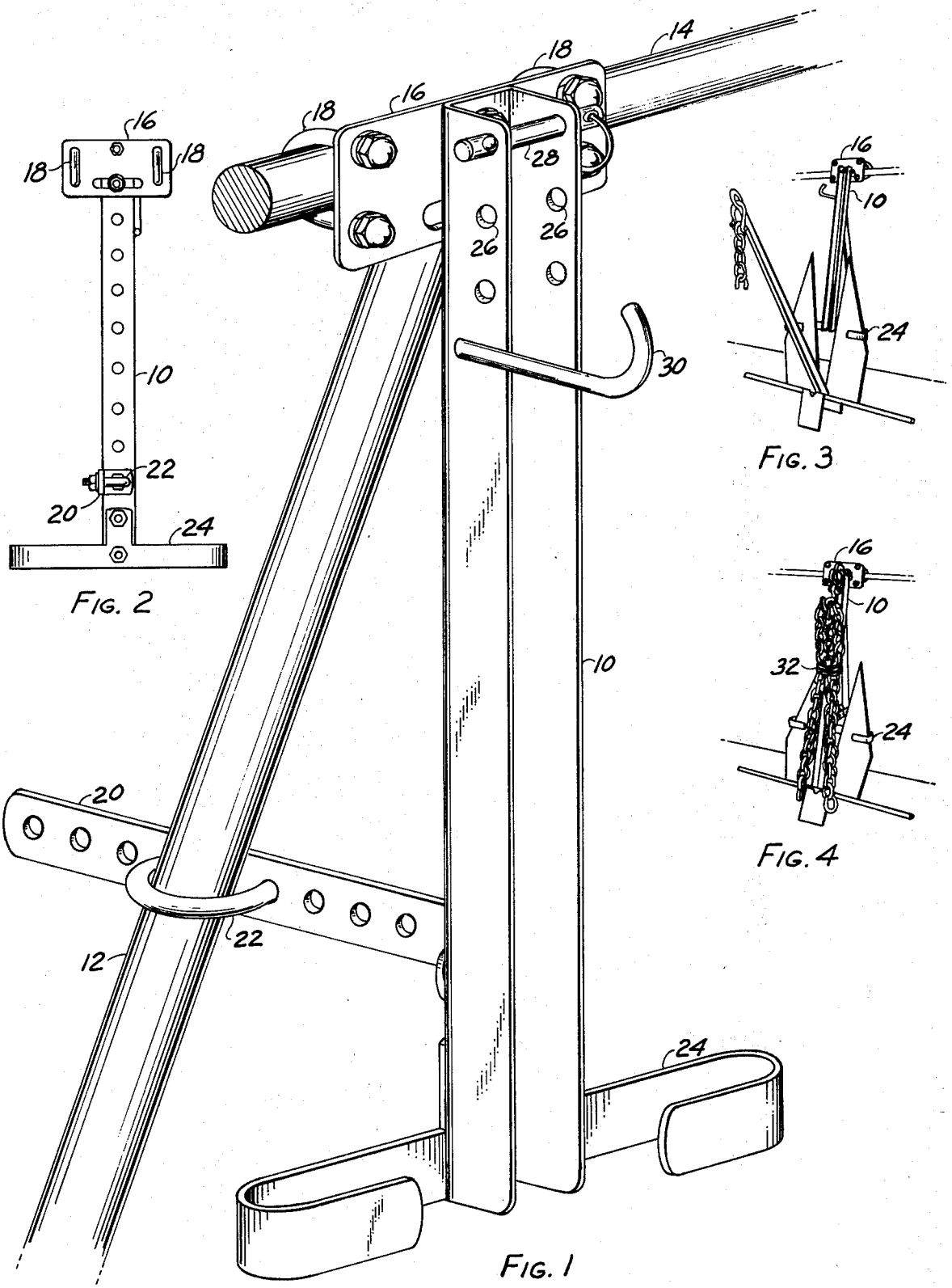
FIG. 1 is a perspective view of a first embodiment of an anchor holder in accordance with the present invention.
FIG. 2 is a rear view, on a reduced scale, of the anchor holder of FIG. 1.
FIGS. 3 and 4 depict, in stepwise fashion, the insertion of an anchor for storage in the holder of FIGS. 1 and 2.

With reference now jointly to FIGS. 1 and 2, in accordance with a first embodiment the anchor holder of the present invention includes a main channel defining member 10. The anchor holder of the present invention is intended for mounting on the rail or pulpit of a vessel; the pulpit upright or stanchion being indicated at 12 and the longitudinal rail member being indicated at 14. In the embodiment of FIG. 1, in order to permit the anchor holder to be mounted on the rail 14, a head bracket 16 is affixed to the rear of channel member 10 adjacent the upper end thereof. As may best be seen from FIG. 2, bracket 16 is attached to channel member 10 by means of a pair of bolts with the lower bolt passing through an elongated slot in bracket 16. This means of mounting bracket 16 permits angular adjustment of the bracket with respect to the channel whereby the anchor holder may be mounted on a vessel having a rail which is not horizontally oriented. The attachment of head bracket 16 to the vessel rail 14 is achieved, in the embodiment of FIGS. 1 and 2, by a pair of U-bolts 18 which pass through bracket 16 adjacent the oppositely disposed side edges thereof as shown.

Intermediate its length, and closer to the lower end than the end to which the head bracket 16 is attached, the main channel member 10 is provided with adjustable extension bracket 20. Bracket 20 extends rearwardly; i.e., in the inboard direction; from main channel member 10 as shown in FIG. 1 and is provided with a plurality of equally spaced apertures. In the FIG. 1 embodiment the bracket 20 is connected to the vessel pulpit upright by means of a U-bolt 22 which engages a pair of the apertures in bracket 20. The bracket 20 is L-shaped and is attached to the rear side of main channel 10, in the preferred embodiment, by a single bolt. Thus, through the expedient of loosening this bolt, the bracket 20 may be rotated slightly to accommodate a pulpit upright which descends from the rail at an angle. The base of channel defining member 10 may be apertured, in the same manner as bracket 20, to permit longitudinal adjustment of the point of attachment of bracket 20 to channel 10.

At or adjacent its lower end, the U-shaped main channel defining member 10 is provided with transversely oriented C-shaped fluke bracket 24. Bracket 24 is affixed to the channel member 10 by means of a pair of bolts in the disclosed embodiment; this arrangement permitting shipment of the anchor holder in disassembled form and permitting the holder to accommodate various size anchors by making the positioning of bracket 24 along channel member 10 adjustable. As briefly noted above, and as may be seen from FIG. 2, the base of the U-shaped channel defining member 10 may be provided with a plurality of evenly spaced holes whereby the point of attachment of either or both of extension bracket 20 or fluke bracket 24 may be adjusted along the length of channel member 10. Fluke bracket 24 extends outwardly to both sides of main channel member 10 and has its free ends bent forwardly and back on themselves so as to be in a facing relationship. In use, as may be seen from FIGS. 3 and 4, the flukes of an anchor are received in the open ended channels defined by the facing ends of fluke bracket 24.

Adjacent its upper end the main channel defining member 10 may be provided with, passing through the side legs of the channel, a plurality of pairs of aligned holes such as indicated at 26. Holes 26 receive a locking pin 28. In most cases only a single pair of holes 26 is required for locking pin 28.

Intermediate its length, but reasonably close to the locking pin receiving holes, a J-shaped member extends outwardly; i.e., in the outboard direction; from main channel member 10. The J-shaped member 30 is preferably welded to one exterior side of channel defining member 10. In use, as may be seen from FIG. 4, the anchor chain will be wrapped around member 30.

In order to install the anchor holder of the present invention on a vessel, the position of fluke bracket 24 is first set such that the flukes of the anchor with which the holder will be used clear the bracket when the shank of the anchor is positioned within main channel member 10 and pinned in place by means of locking pin 28. Next, the extension bracket 20 is bolted to member 10; the point of attachment typically being immediately above the upper end of the fluke bracket 24. Thereafter, the head bracket 16, which has previously been bolted to channel 10, is attached to the pulpit rail 14 by means of the U-bolts 18. Finally, the extension bracket 20 is affixed to the pulpit upright 12 by means of U-bolt 22; the placement of U-bolt 22 in extension 20 typically resulting in the main channel 10 being as close to vertical as possible and the vertical orientation being aided by the fact that head bracket 16 has not yet been tightly bolted to channel 10. All bolts are tightened and it is usually desirable, but not mandatory, to cut off that portion of extension bracket 20 which extends to the inboard side of the pulpit upright 12.

Considering FIGS. 3 and 4, in use the flukes of an anchor are guided into the fluke retainer bracket 24 from the bottom as depicted in FIGS. 3. The anchor shank is then rotated into the channel defined by main channel member 10 and pinned in position by passing the pin 28 through a pair of aligned holes 26 in channel 10 and the hole provided at the upper end of the shank of the anchor for receiving the anchor chain swivel connector. Next, as may be seen from FIG. 4, the anchor chain is wrapped firmly around the bottom of the anchor and the J-shaped member 30. Thereafter, it is preferable to tie the chain, shank and anchor holder together with nylon line or shock cord as indicated at 32 thereby providing a neat outboard bundle. With the anchor installed in the anchor holder as depicted in FIG. 4, the shackled rode can be led through the deck fitting and into the rode locker.

Figure 5:
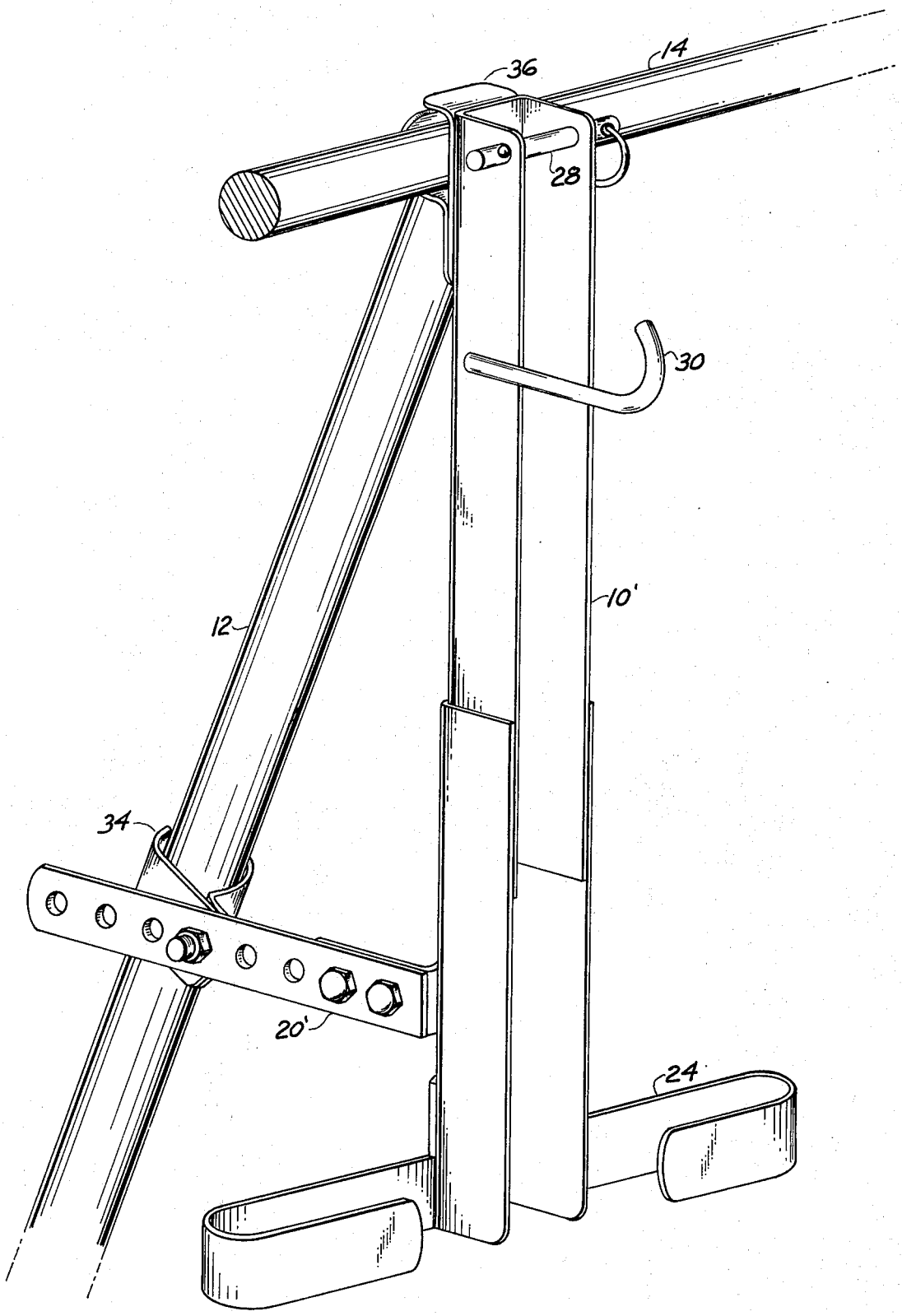
FIG. 5 is a perspective view of the second embodiment of an anchor holder in accordance with the invention.

A second embodiment of the invention is depicted in FIG. 5. The embodiment of FIG. 5 differs from that of FIG. 1 in several respects. First, the main channel defining member, indicated at 10' in FIG. 5, is telescoping. The main channel locked in the appropriate length position by means of bolts which pass through the array of spaced holes in the bases of the telescoping members which define main channel 10'; such holes being shown in FIG. 2. Use of a telescoping main channel member 10' permits the fluke bracket 24 to be welded into position on the bottom of the main channel member 10. Also in the FIG. 5 embodiment, the L-shaped extension bracket 20 is of two piece construction and, rather than utilizing the U-bolt 22 of FIG. 1, employs a pivotally mounted two piece clamp 34 for connecting the bracket to the pulpit upright 12. Similarly, at the upper end of the main channel member 10 in the FIG. 5 embodiment the head bracket 16 has been eliminated and, in its place, there is provided a one or two piece clamp 36 functionally identical to the clamp 34. Clamp 36 will be held to main channel member 10 by means of a single bolt and thus will be pivotal. The provision of pivoting pulpit engaging clamps 34 and 36, the telescoping main channel 10' and the adjustability of the point of attachment of clamp 34 to extension bracket 20 allows the anchor holder of the present invention to be installed on almost all vessels having a bow or stern pulpit with the main channel 10 oriented substantially vertically.

While preferred embodiments have been shown and described, various modifications and substitutions may be made thereto without departing from the spirit and scope of the invention. Accordingly, it is to be understood that this invention has been described by way of illustration and not limitation.

What is claimed is:

1. An anchor holder comprising:

means defining an elongated open-sided channel, said channel being sized to receive the shank of an anchor;

first connector means mechanically coupled to said channel defining means adjacent a first end thereof for mounting said channel defining means to a rail of a vessel;

second connector means mechanically coupled to said channel defining means intermediate its length for supporting said channel defining means from a vessel stanchion, said second connector means extending outwardly from said channel defining means and being adjustable in length;

anchor fluke bracket means, said fluke bracket means being mountable on said channel defining means and defining a pair of facing anchor fluke receiving openings; and locking means, said locking means engaging said channel defining means and the shank of an anchor positioned therein, whereby said channel defining means, locking means, and fluke bracket means may support an anchor in a stored position.

2. The anchor holder of claim 1 wherein said channel defining means is adjustable in length.

3. The anchor holder of claim 2 wherein the point of attachment of said second connector means to said channel defining means is adjustable along the length of said channel defining means.

4. The anchor holder of claim 3 wherein said means for connecting said channel defining means to the vessel rail comprises:

clamp means, said clamp means being pivotal with respect to said channel defining means at least through a limited range of movement.

5. The anchor holder of claim 4 wherein said adjustable length second connector means comprises:

L-shaped bracket means, the base of said L-shaped bracket means being attachable to the rear of said channel defining means; and pivotal bracket means adjustably positionable on said L-shaped bracket means.

6. The anchor holder of claim 1 wherein the point of attachment of said second connection means to said channel defining means is adjustable along the length of said channel defining means.

7. The anchor holder of claim 6 wherein said means for connecting said channel defining means to the vessel rail comprises:

clamp means, said clamp means being pivotal with respect to said channel defining means at least through a limited range of movement.

8. The anchor holder of claim 1 wherein said means for connecting said channel defining means to the vessel rail comprises:

clamp means, said clamp means being pivotal with respect to said channel defining means at least through a limited range of movement.

9. The anchor holder of claim 1 further comprising:

finger means, said finger means extending outwardly from said channel defining means in the direction faced by the open side of said channel defining means, said finger means being adapted to engage and support the chain of an anchor received in said anchor holder.

10. The anchor holder of claim 1 wherein said adjustable length second connector means comprises:

L-shaped bracket means, the base of said L-shaped bracket means being attachable to the rear of said channel defining means; and pivotal bracket means adjustably positionable on said L-shaped bracket means.

* * * * *